US005960908A

United States Patent [19]

Kasahara

[11] Patent Number: 5,960,908

[45] Date of Patent: Oct. 5, 1999

[54] OIL PAN BAFFLE PLATE

[75] Inventor: Satoshi Kasahara, Shizuoka-ken, Japan

[73] Assignee: Suzuki Motor Corporation, Japan

[21] Appl. No.: 08/927,909

[22] Filed: Sep. 11, 1997

[30] Foreign Application Priority Data

Nov. 26, 1996 [JP] Japan ..... 8-330480

[51] Int. Cl.[6] ..... F01M 11/00

[52] U.S. Cl. ..... 184/106; 184/6.23

[58] Field of Search ..... 184/106, 1.5, 6.23, 184/6.24; 96/204; 123/196 R, 195 C

[56] References Cited

U.S. PATENT DOCUMENTS

| | | | |
|---|---|---|---|
| 3,101,129 | 8/1963 | Hulten | 184/106 |
| 4,938,184 | 7/1990 | Martin et al. | 123/196 R |
| 5,136,993 | 8/1992 | Ampferer et al. | 184/106 |
| 5,332,423 | 7/1994 | Gisko et al. | 96/204 |
| 5,465,692 | 11/1995 | Uraki et al. | 184/106 |
| 5,469,822 | 11/1995 | Mechsner | 184/106 |
| 5,653,205 | 8/1997 | Ozeki | 123/195 C |
| 5,662,080 | 9/1997 | Isono et al. | 184/106 |
| 5,664,537 | 9/1997 | Beranek et al. | 184/106 |

*Primary Examiner*—Tamara L. Graysay
*Assistant Examiner*—David Fenstermacher
*Attorney, Agent, or Firm*—Morrison Law Firm

[57] ABSTRACT

A baffle plate 17 inside an oil pan 16 attached to the lower part of an engine cylinder block is spherically shaped so as to bulge upward, and oil dropping holes are formed in low positions in this baffle plate 17. Return oil flow from the engine lubricating operation drops from the engine onto the baffle plate and travels along the baffle plate toward the walls of the oil pan, this travel facilitating removal of air which became mixed with the oil during the lubricating operation. Oil dropping holes are formed in low positions in the baffle plate to communicate the oil return to the pool of same in the oil pan. In addition, beads 19 that direct oil flow toward the oil dropping holes are provided on baffle plate 17. In addition to eliminating poor engine lubrication operation due to air entrapped in the lubricating oil by helping rid the oil of the air, the spherically shaped baffle plate has enhanced resistance to cracking under loading imposed thereon.

5 Claims, 10 Drawing Sheets

PRIOR
ART

OIL PAN BAFFLE PLATE

BACKGROUND OF THE INVENTION

The present invention relates to an oil pan baffle plate and, more particularly, to an oil pan baffle plate that more effectively removes air from engine lubricating oil return dropping thereon so that lubricating performance of the oil is not diminished.

FIG. 7 is an overall view of a conventional automobile engine 1, and FIGS. 8–10 show an oil pan 2 that attaches to the lower part of engine 1. Oil pan 2 is filled with a pool of lubricating oil 3 from which oil is supplied in known manner to the engine 1 for providing a lubricating film of oil between sliding friction parts in the engine 1 thereby avoiding direct contact between one metal part and another so that wear between the two is prevented. Reference numeral 3*a* in FIG. 7 denotes the surface of the pool of oil.

Supply of oil from the pool is drawn up through oil strainer 4 to the engine, lubricates various parts including crankshaft 6 and connecting rod 7 inside cylinder block 5 and cam shaft 9 inside cylinder head 8, discharging therefrom inside engine 1, and returns to oil pan 2 from the upper part of the engine by the force of gravity.

Oil 3 that is discharged into engine 1 falls to the bottom of engine 1 and onto baffle plate 10 in oil pan 2. Because the oil 3 that descends onto baffle plate 10 contains a large quantity of mixed-in air, if it flows into oil pan 2 in this state, there is concern that it will be drawn up through oil strainer 4 and air presence therein will result in poor lubrication of engine parts. For that reason the air is removed before it is drawn into oil strainer 4.

As shown in FIGS. 7 and 8, the baffle plate 10 in the short direction thereof (i.e., the direction of line A—A in FIG. 9 and viewing the oil pan 2 from the front) only of baffle is curved so as to bulge upward, so that oil 3 falling on the upper surface of baffle plate 10 conveys or travels to the walls on both sides (horizontally, in FIG. 9) of oil pan 2. During that travel, air will remove from the oil before it flows down into the pool of oil 3.

As seen from FIG. 10, the long direction of oil pan 2 has a shallow-bottom part 2A and a deep-bottom part 2B, so that oil 3 that seeps into oil pan 2 from gap 2C between oil pan 2 and baffle plate 10 (FIG. 9) loses its air as it flows along the shallow-bottom part 2A. Also, as shown in FIG. 10, the baffle plate 10, in its long direction, is not curved but rather, is straight.

Reference numeral 11 in FIG. 9, denotes an opening in baffle plate 10 through which oil strainer 4 is received, and around the rim of this opening 11 is a flange 11*a* that keeps oil 3 from flowing through the opening. Plural oil dropping holes 12 are provided in the baffle plate 10. The oil dropping hole 12 that communicates with opening 11 also serves as a pass through hole for pipe 4*a* of oil strainer 4 (see FIG. 7).

Again referring to FIG. 9, reference numeral 13 denotes beads on baffle plate 10, reference numeral 14 denotes attachment bolt holes in flange 15 of oil pan 2 for attachment to cylinder block 5, and reference numeral 15*a* denotes an insertion hole for an oil level gauge. In FIG. 10, 10*a* is a flange on the outer rim of baffle plate 10.

In the prior art described above, baffle plate 10 in oil pan 2 is shaped with a curve so that the short direction of oil pan 2 projects upward, while it is not curved in its long direction. This creates the problem that the oil 3 that falls from above flows easily in the short direction but not in the long direction.

This creates the problem that oil 3 does not flow fully to the inner wall around oil pan 2, and oil 3 that does not flow fully to the inner wall around the oil pan 2 falls through opening 11 at the oil strainer 4 into the oil pool 3 with air still mixed in, and when oil is drawn through strainer 4 taking along the air mixed in, poor lubrication results.

Another problem is that when a load is applied to oil pan 2 in either the tensile direction (see FIG. 11) or the compression direction, the side curved in the short direction is easily deformed, while it is not easily deformed in the long direction. That is, the problem is that the baffle plate 10 can withstand a load in its short direction but not a load in its long direction, and it will crack as shown by symbol C in FIG. 12.

An engine bearing cap is disclosed in Japanese published utility model application HEI 1-113116 [1989] which supports a crankshaft, is joined to the lower side of the engine block. Formed integrally with said bearing cap for each air tube is a baffle plate having a shape that is curved along the rotation path of a connecting rod, etc. between the bearings of this bearing cap, and oil return holes are provided in the upper part of each curved part of the baffle plate.

The baffle plate of the utility model application has a curved shape between the bearings of the bearing cap that supports the crankshaft. The baffle plate is formed integrally with the bearing cap, but because the baffle plate is shaped with a curve that follows the path of rotation of the connecting rod, etc., the baffle plate is curved only in the direction of one side of the oil pan (the direction of the rotation path). Therefore there is no shape curved toward the other side, and if a load is applied in the other direction, there is concern that the baffle plate, being unable to deform, will crack.

OBJECTS AND SUMMARY OF THE INVENTION

It is an object of the invention to an oil pan baffle plate which overcomes the drawbacks of the prior art.

Another object is to provide an oil pan baffle plate which improves the engine lubrication operation by effecting sure and enhanced removal of any air entrapped in the engine return lubricating oil before that oil reenters the oil pan lubricating oil pool.

A further object is to provide an oil pan baffle plate which has upwardly directed spherical shape in each of two horizontal dimensions of said plate so that return oil flow thereon is along a course calculated to allow air liberation therefrom before the oil accesses any plate opening communicating with the oil pan.

A still further object is to provide an oil pan baffle plate which is strengthened against any cracking thereof during its normal use and presence within the oil pan.

The present invention solves the previously noted problems by providing an oil pan baffle plate structure which eliminates poor lubrication by sure removal of the air in the oil, and which further prevents cracking of the baffle plate in use because the upward spherical shape of the baffle plate gives it flexibility with respect to a load on the oil pan applied from any direction.

Beads directed toward oil dropping holes are formed in the baffle plate and extend from a high side of the baffle plate to a plate low side, the beads being pointed toward oil dropping holes.

Briefly stated, there is provided a baffle plate inside an oil pan attached to the lower part of an engine cylinder block that is spherically shaped so as to bulge upward. Oil dropping holes are formed in low positions in this baffle plate. Return oil flow from the engine lubricating operation drops from the engine onto the baffle plate and travels along the baffle plate toward the walls of the oil pan. This travel facilitates removal of air which became mixed with the oil during the lubricating operation. Oil dropping holes are formed in low positions in the baffle plate to communicate the oil return to the pool of same in the oil pan. In addition, beads that direct oil flow toward the oil dropping holes are provided on baffle plate. In addition to eliminating poor engine lubrication operation due to air entrapped in the lubricating oil by helping rid the oil of the air, the spherically shaped baffle plate has enhanced resistance to cracking under loading imposed thereon.

In accordance with these and other objects of the invention, there is provided an oil baffle plate mountable inside an oil pan connected to a lower part of an engine cylinder block. The oil baffle plate has an expanse with a long direction and a short direction crosswise to the long direction, the baffle plate being spherically shaped so as to project upwardly from baffle plate long direction and short direction marginal low parts to baffle plate remainder high parts. The baffle plate further has oil dropping holes located therein at said long direction and short direction marginal parts which oil dropping holes communicate with said oil pan. Baffle plate surface areas which extend between said remainder high parts and said oil dropping holes define a gravity induced oil flow course on which any air entrapped in the oil flow can liberate from the oil as it flows from the baffle plate remainder high parts toward said oil dropping holes.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
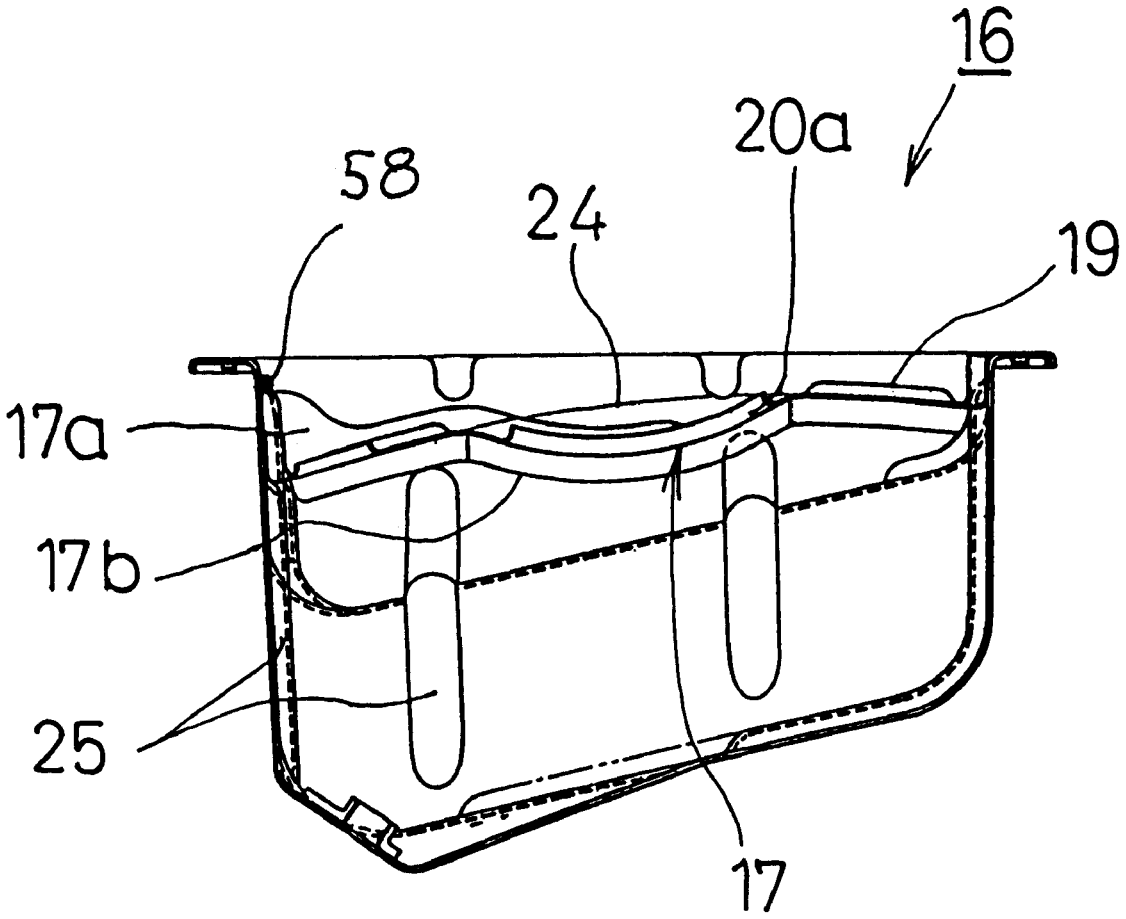
FIG. 1 is a cross-sectional view of an embodiment of the invention as taken along line D—D in FIG. 3.
Figure 2:
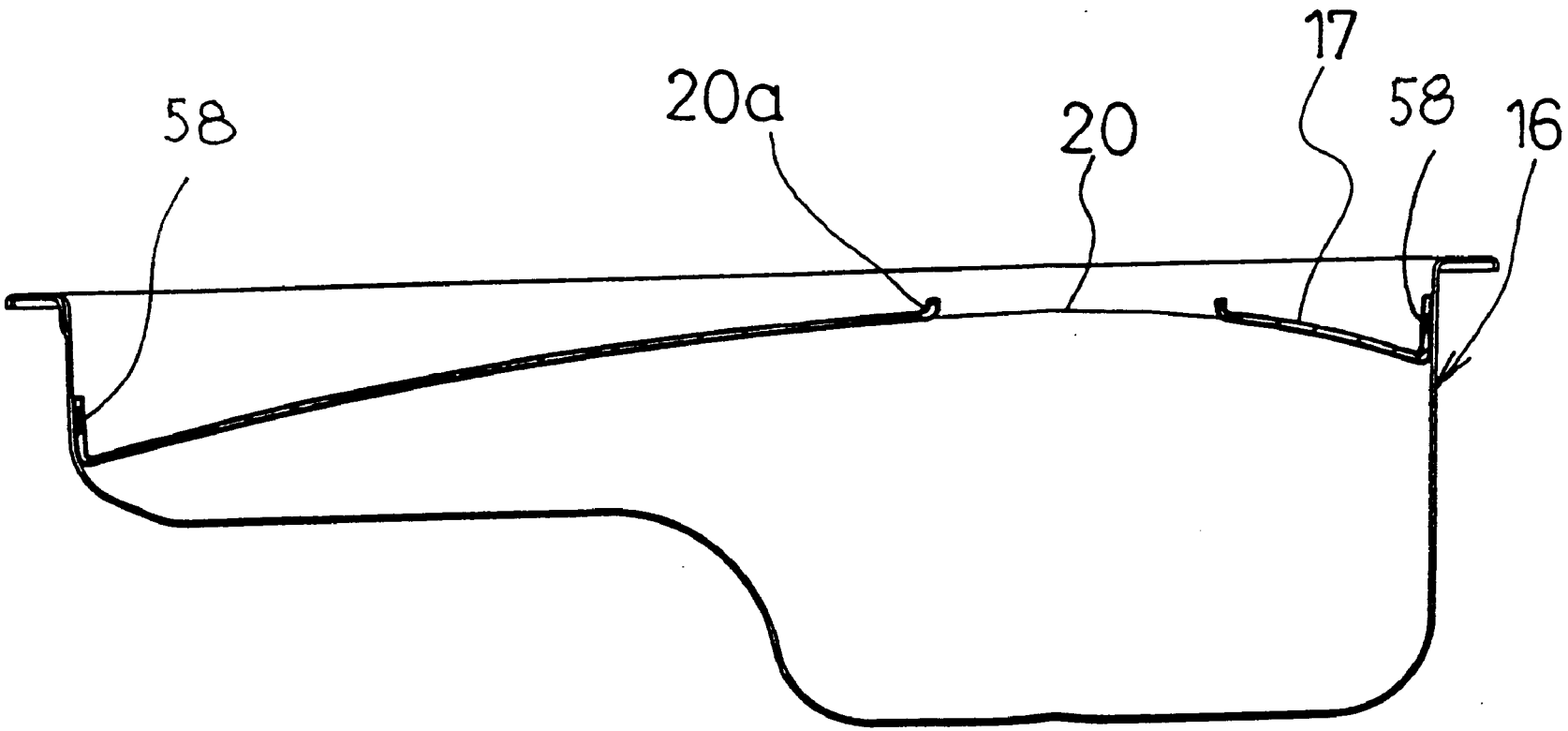
FIG. 2 is a cross sectional view taken along line E—E in FIG. 3.
Figure 3:
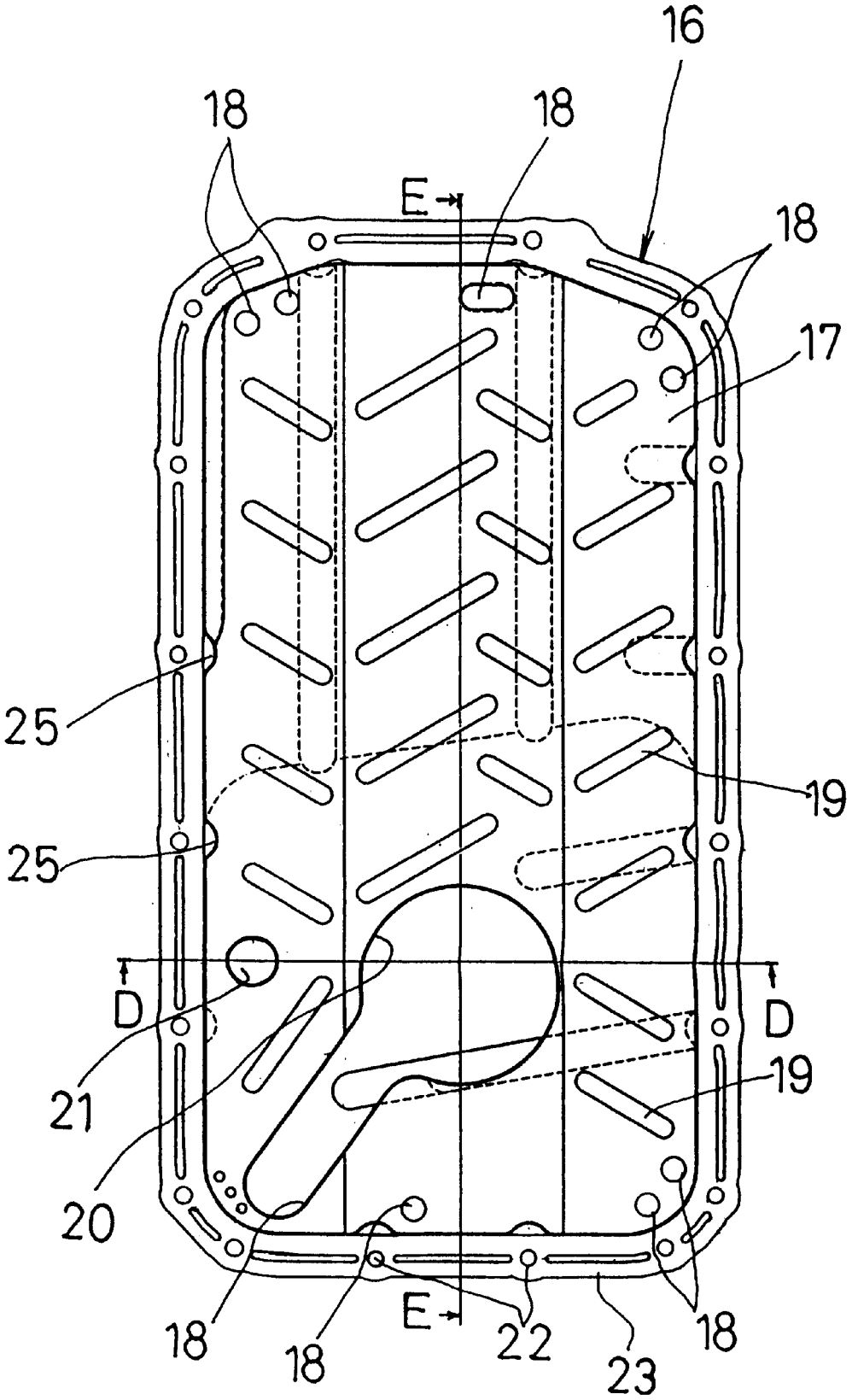
FIG. 3 is a top view of an oil pan having the baffle plate of this invention.

Referring to FIGS. 1–3, the oil pan 16 of the invention carries a baffle plate 17 therein. Baffle plate 17 has a generally spherical shape that projects upwardly as best seen from FIGS. 1 and 2. More specifically, as shown in FIG. 1, the short direction of oil pan 16 of baffle plate 17 has a wavelike spherical shape. That is, two discrete spherical shapes are provided in the upward direction. Also, as shown in FIG. 2, the long direction of oil pan 16 is a single spherical shape that projects upward.

As shown in FIG. 3, plural oil dropping holes 18 are provided in low positions of baffle plate 17, and through these, return oil 3 from the lubrication operation can pass from the upper surface of baffle plate 17 into the oil pool in oil pan 16. In addition, plural beads or ribs 19 are formed in baffle plate 17 in order to improve the strength of baffle plate 17. These beads or ribs 19 are provided in such a way as to direct the flow toward the oil dropping holes 18 from the upper part of the baffle plate to the lower part.

An opening 20 for oil strainer 4 is provided in baffle plate 17 as is an insertion hole 21 for an oil level gauge. The oil dropping hole 18 that communicates with opening 20 for oil strainer 4 also serves as a pass through hole for pipe 4*a* of oil strainer 4 (see FIG. 4).

Along the edge of opening 20 for oil strainer 4 is a raised flange 20*a* which serves to prevent air-containing oil 3 on baffle plate 17 from easily getting into oil pan 16 (see FIG. 2). Attachment bolt holes 22 are provided in flange 23 along the edge of oil pan 16 for attaching the oil pan to cylinder block 5.

As seen in FIG. 1, a flange 17*a* is provided on the outer perimeter of baffle plate 17. The baffle plate has a lower surface as at 17*b*. Reference numeral 24 is the virtual line of the short direction of the upwardly projecting spherical shape of baffle plate 17, there being beads or ribs as at 25 on the walls of oil pan 16.

Figure 4:
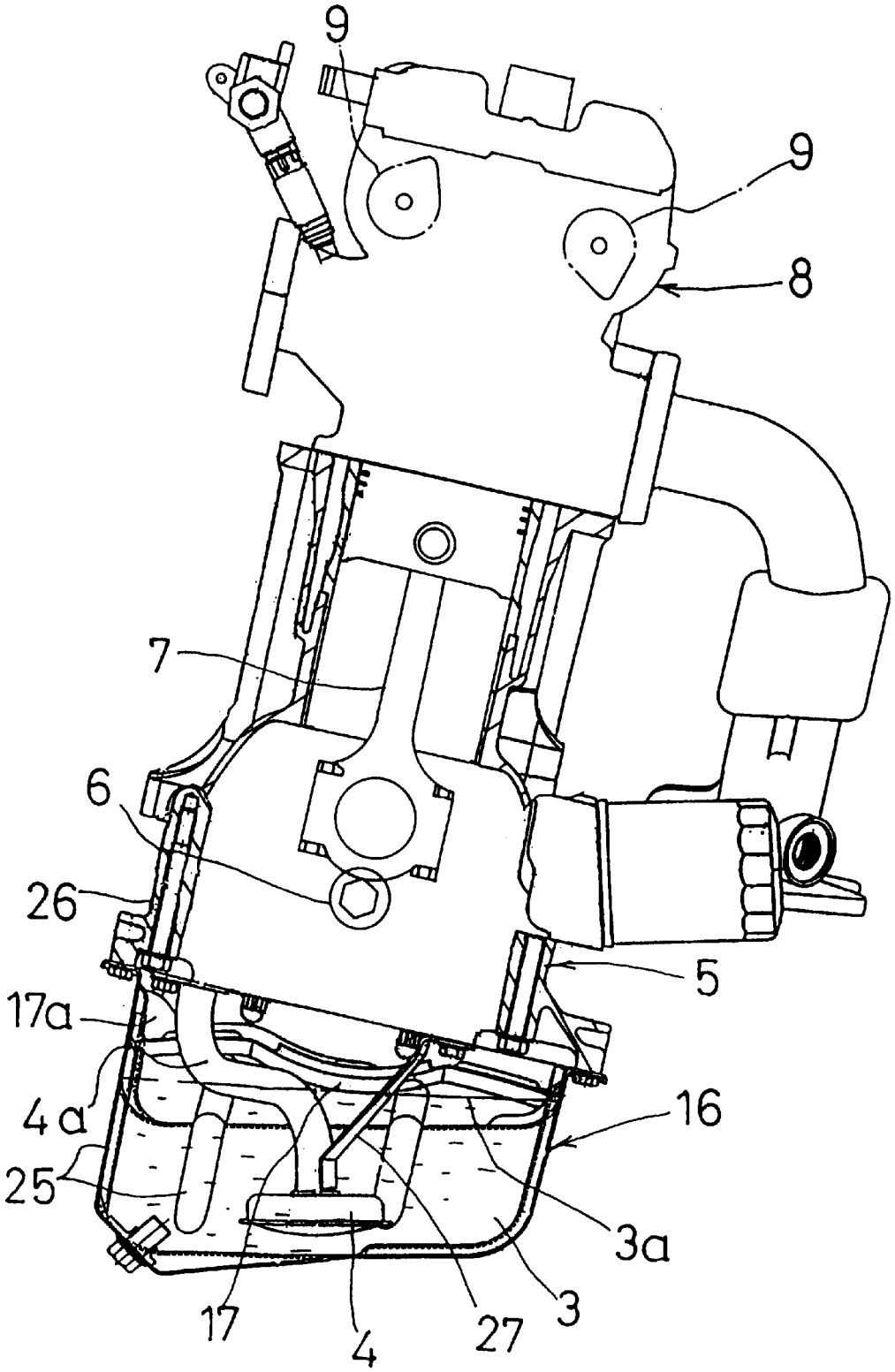
FIG. 4 is a front elevational view partly in section view of an engine to which is attached an oil pan having the baffle plate of this invention.

In this way, oil pan 16, inside which is provided baffle plate 17, is attached to the lower surface of lower case 26 of cylinder block 5 as shown in FIG. 4. The attachment is made by inserting bolts (not shown) through attachment bolt holes (not shown) in the oil pan alignment surface of lower case 26 and attachment bolt holes 22 in flange 23 of oil pan 16. The baffle plate 17 can be attached to the oil pan 16 by spot welding as, for example, shown at 58 in FIGS. 1 and 2.

When this is done, oil strainer 4 is held secured to lower case 26, and because strainer bracket 27 is attached thereto, oil strainer 4 and its pipe 4*a*, as well as strainer bracket 27, are fitted in using opening 20 in baffle plate 17 and oil dropping holes 18 that communicate with opening 20.

FIG. 4 shows engine 1, in which oil pan 16 carrying baffle plate 17, is attached to the lower part of cylinder block 5. Lubricating oil 3 inside oil pan 16 is drawn up through oil strainer 4 and lubricates engine parts including crankshaft 6 inside cylinder block 5, connecting rod 7, and cam shaft 9 inside cylinder head 8, the oil being discharged inside engine 1 for return to the pool. Oil 3 that is thus discharged falls downward by gravity from the top of engine 1 and returns again to oil pan 16.

In this way, oil 3 that trickles down through the engine arrives at the upper surface of baffle plate 17, and because baffle plate 17 is curved so as to protrude upward, that is, because baffle plate 17 is curved in both the short direction and long direction of oil pan 16, and because furthermore beads or ribs 19 on baffle plate 17 guide it toward oil dropping holes 18 and extend along from the high side to the low side, the oil 3 that descends from the upper part of engine 1 and arrives at baffle plate 17 efficiently moves to the inside wall around oil pan 16 without being impeded by beads 19.

During this movement, the air that is mixed in oil 3 is removed, and oil 3 in which no air is present flows into the oil 3 in oil pan 16. Thus, oil strainer 4 no longer draws up oil 3 in which air is mixed and lubrication performance is enhanced.

Figure 5:
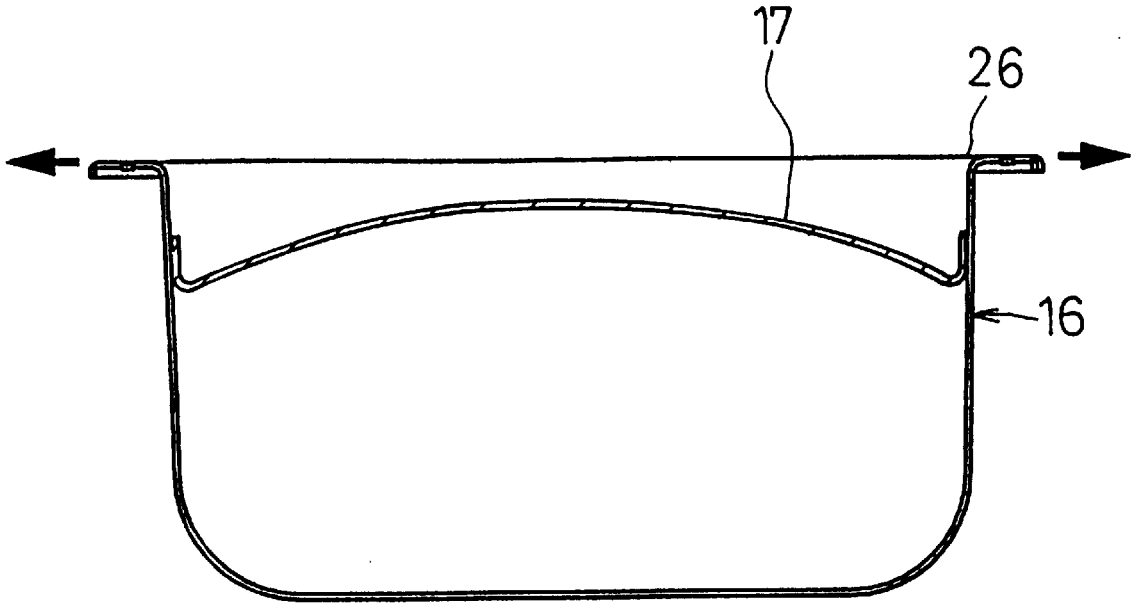
FIG. 5 is a cross-sectional view that shows a load being applied to an oil pan having the baffle plate of this invention.
Figure 6:
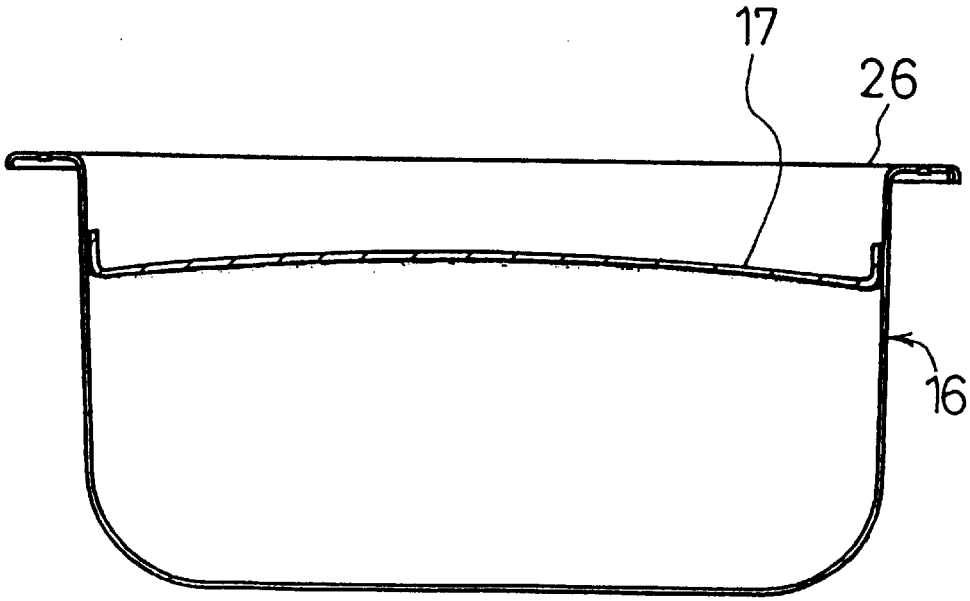
FIG. 6 is a cross-sectional view that shows how the baffle plate in FIG. 5 has been deformed.
Figure 7:
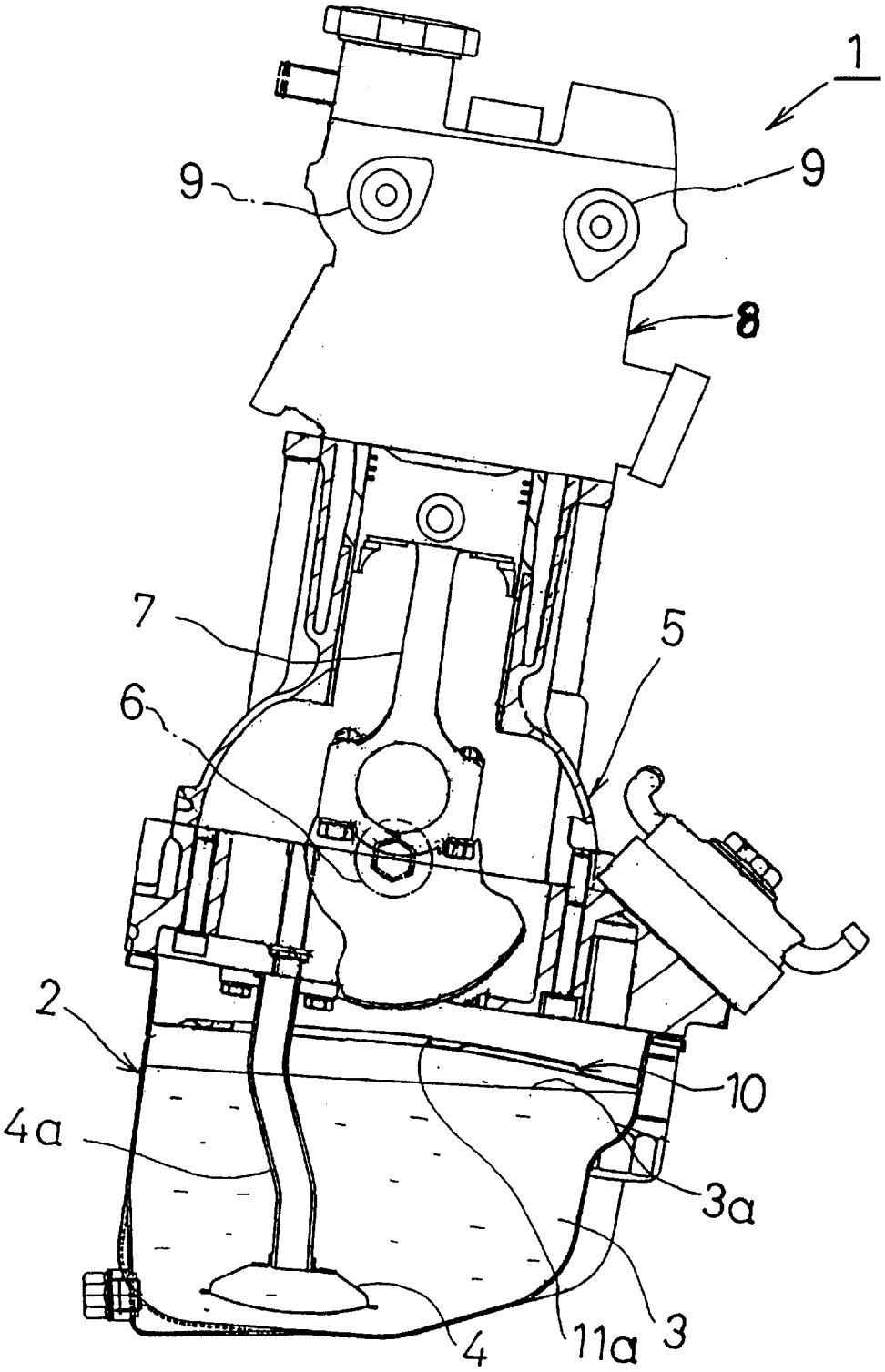
Fig. 7 PRIOR ART
FIG. 7 is a front elevational view partly in section of an engine to which is attached an oil pan having a conventional baffle plate.
Figure 8:
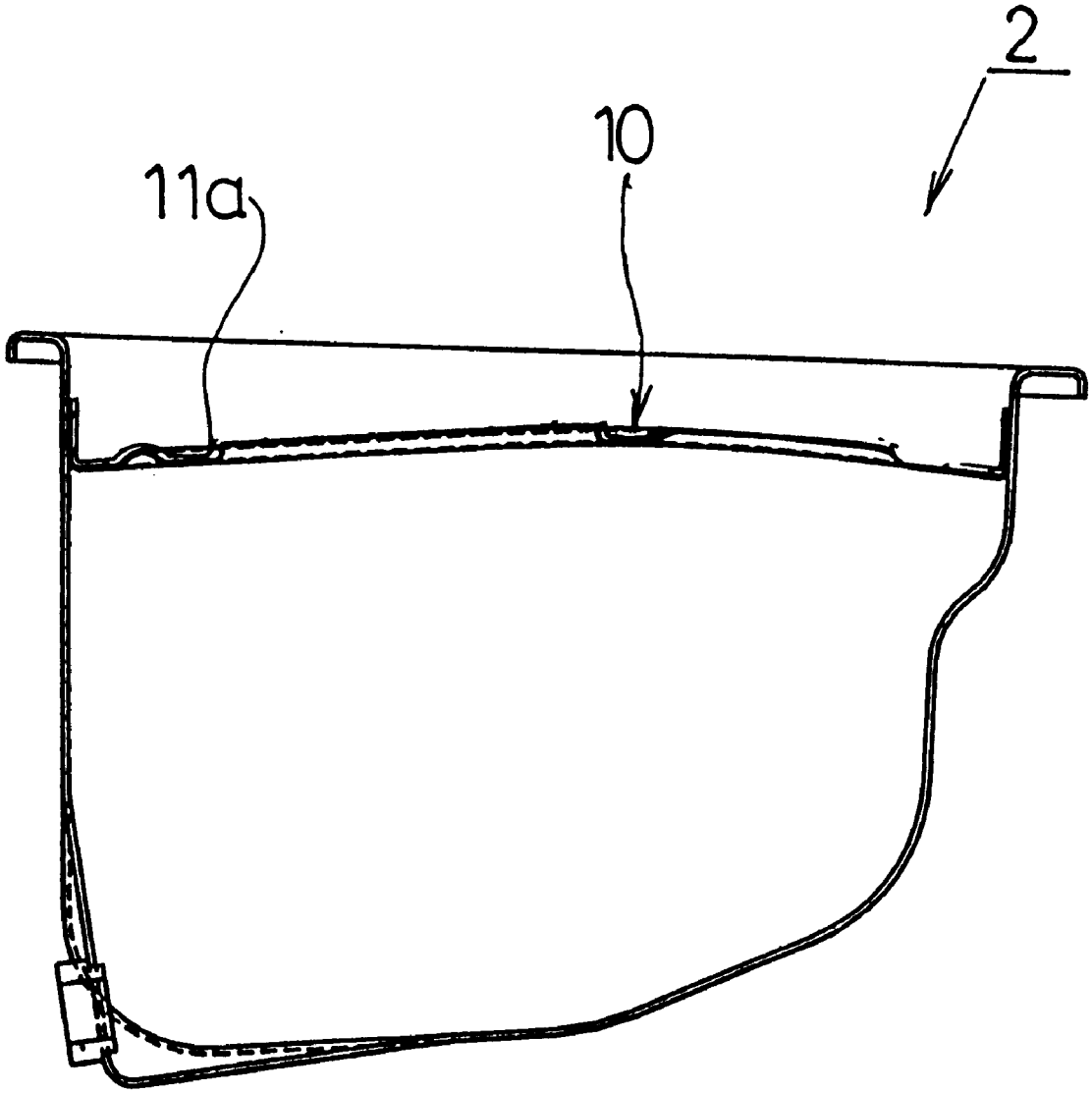
Fig. 8 PRIOR ART
FIG. 8 is a cross-sectional view along line A—A in FIG. 9 of a conventional baffle plate.
Figure 9:
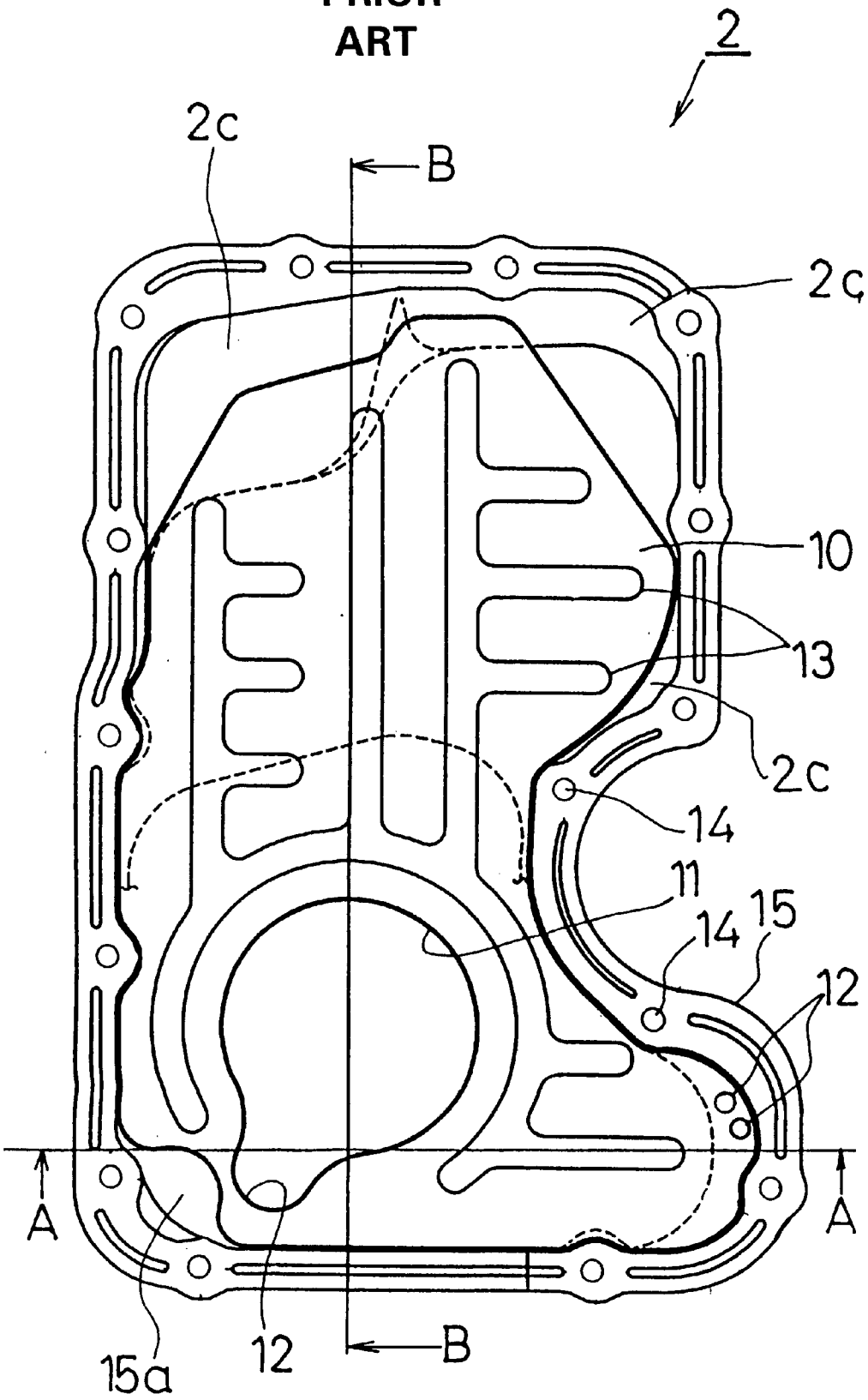
Fig. 9 PRIOR ART
FIG. 9 is a top view of an oil pan with a conventional baffle plate.
Figure 10:
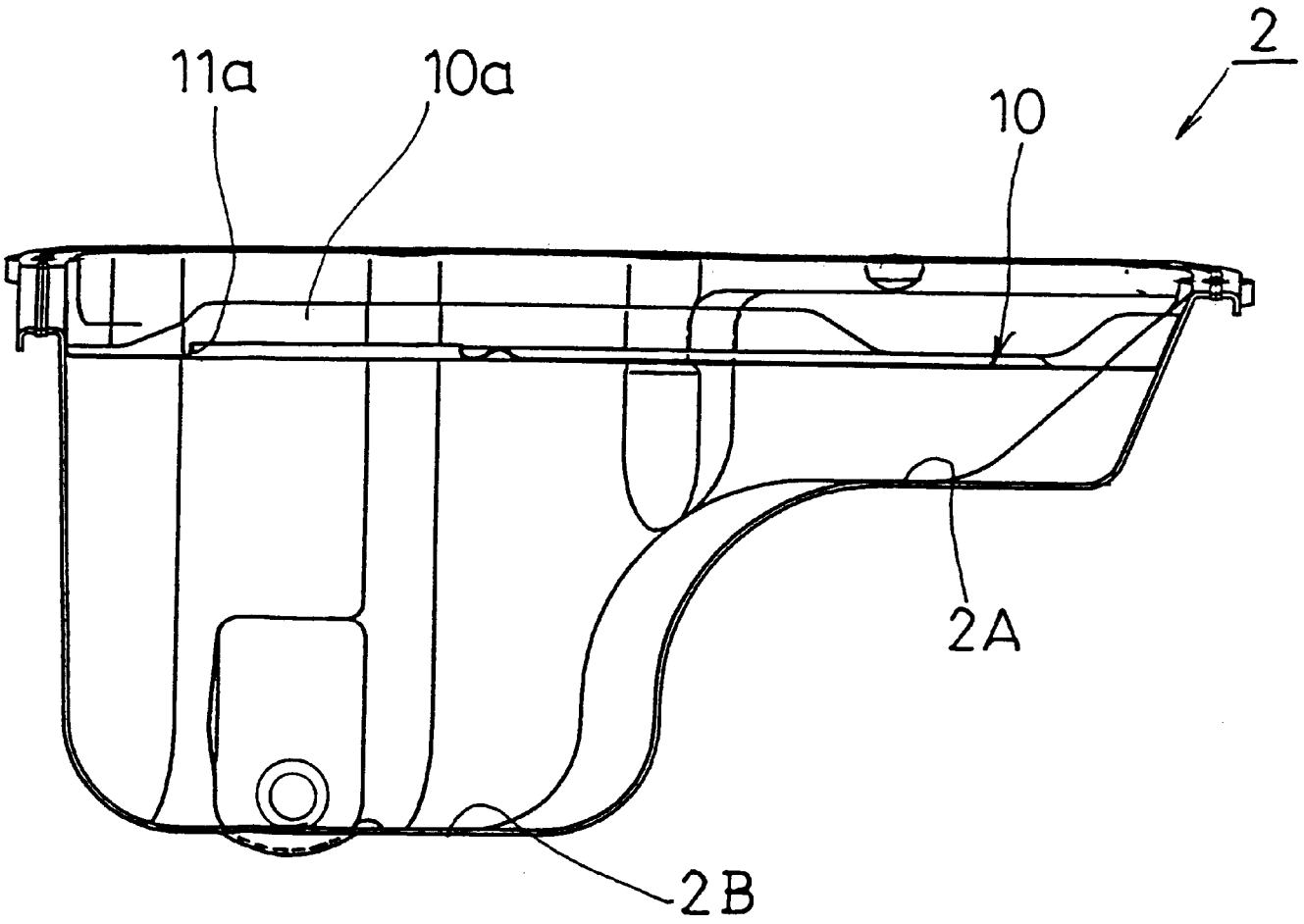
FIG. 10 is a cross sectional view along line B—B in FIG. 9.
Figure 11:
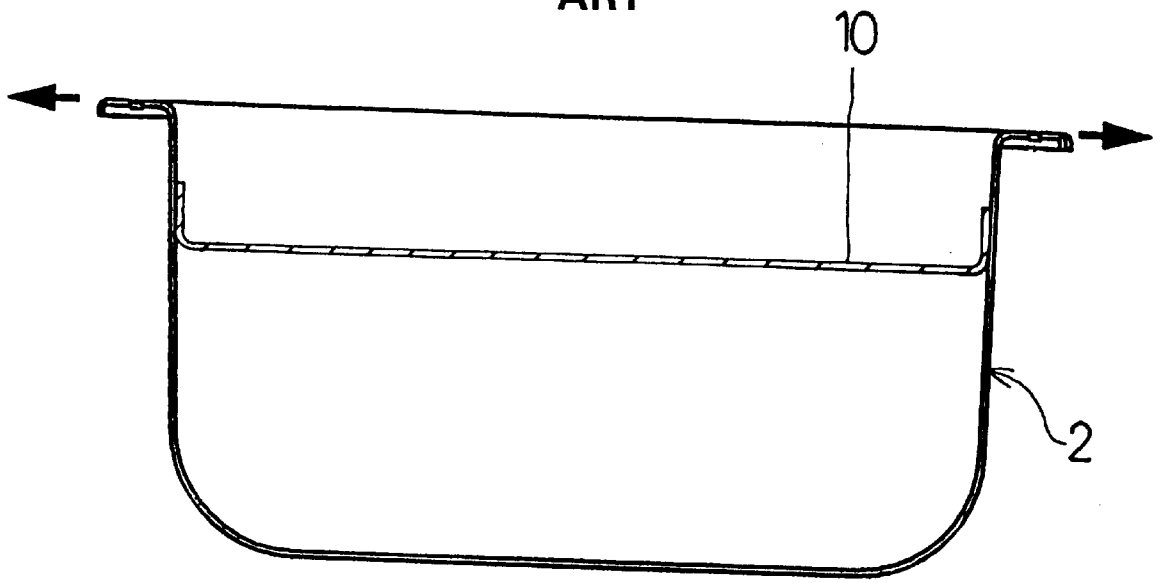
Fig. 11 PRIOR ART
FIG. 11 is a cross sectional view that shows how a load is applied to an oil pan having a conventional baffle plate.
Figure 12:
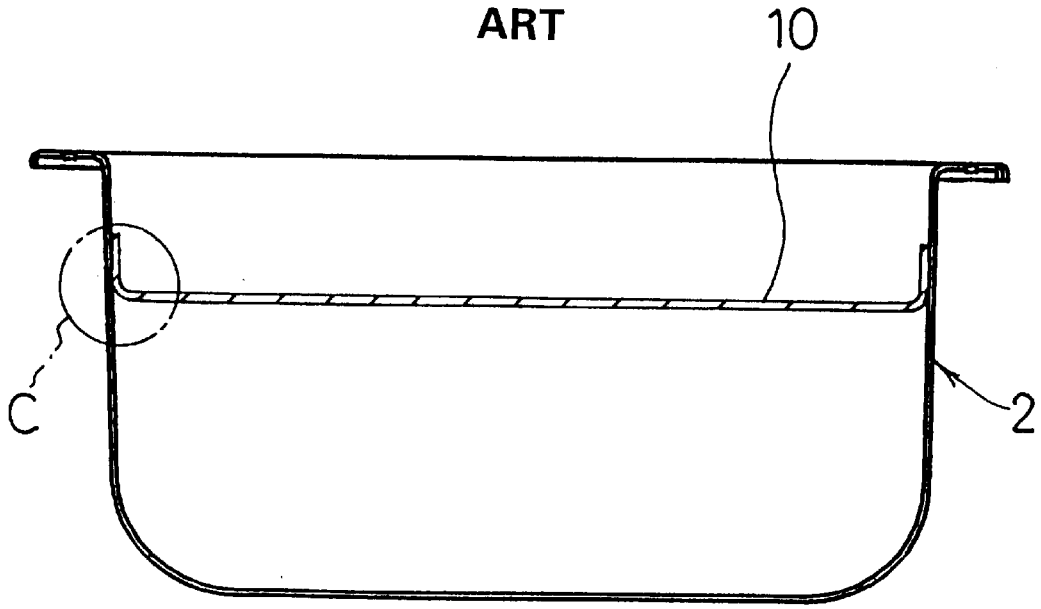
Fig. 12 PRIOR ART
FIG. 12 is a cross sectional view showing where the baffle plate of FIG. 11 has cracked under loading.

Because baffle plate 17 attached to oil pan 16 is spherically shaped so as to protrude upward, the baffle plate has flexibility with respect to a load on oil pan 16 from any direction, and cracking will not occur. For example, even if a load is applied to oil pan 16 in the tensile direction as shown in FIG. 5, baffle plate 17 will not crack, but only its curved shape will change or deform in a slight flattening thereof, as shown in FIG. 6.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An oil baffle plate mountable inside an oil pan connected to a lower part of an engine cylinder block comprising:

an expanse with a long direction and a short direction crosswise to said long direction;

said baffle plate having a convex shape relative to said engine cylinder block;

said convex shape includes a widthwise convex shape formed by said baffle plate being viewed from a side cross-sectional view and a lengthwise convex shape formed by said baffle plate being viewed from a front cross-sectional view;

at least one oil dropping hole;

said at least one oil dropping hole located at a lower portion of said convex shape of said baffle plate;

said at least one oil dropping hole provides a means for an oil flow from said baffle plate to said oil pan;

said baffle plate having a surface area which extends between an upper portion of said convex shape and said at least one oil dropping hole defining a gravity induced oil flow course on which any air entrapped in said oil flow is liberated from said oil flow as it flows from said upper portion toward said at least one oil dropping hole;

a first flange provided on the outer perimeter said baffle plate;

a second flange provided along the edge of an opening for an oil strainer; and said first flange and said second flange providing a means to prevent said oil flow from reaching said oil pan without first passing through said at least one oil dropping hole.

2. The oil baffle plate of claim 1 further comprising stiffening ribs; and said stiffening ribs provided in said upper portion in an array so as to direct flow of oil from said upper portion to said at least one oil dropping hole.

3. The oil baffle plate of claim 1 wherein said widthwise convex shape includes at least two discrete higher portions, each adjacent pair of said discrete higher portion having a discrete lower portion located in substantially the center of said adjacent pair.

4. The oil baffle plate of claim 2 wherein said lengthwise convex shape has a single spherical shape.

5. The oil baffle plate of claim 1 in which the baffle plate is connected to the oil pan by welding.

* * * * *